United States Patent [19]

Peterson

[11] Patent Number: 4,629,227

[45] Date of Patent: Dec. 16, 1986

[54] LATCHING MECHANISM

[75] Inventor: Steven G. Peterson, Waseca, Minn.

[73] Assignee: E. F. Johnson Company, Waseca, Minn.

[21] Appl. No.: 672,572

[22] Filed: Nov. 16, 1984

[51] Int. Cl.[4] ..... E05C 19/06

[52] U.S. Cl. ..... 292/19; 292/86; 292/87

[58] Field of Search ..... 292/19, 17, 80, 83, 292/85, 86, 87

[56] References Cited

U.S. PATENT DOCUMENTS

| | | | |
|---|---|---|---|
| 1,372,812 | 3/1921 | Harmon | 292/87 X |
| 1,785,468 | 12/1930 | Yancey | 292/87 |
| 2,073,851 | 3/1937 | Powell | 292/19 X |
| 2,370,003 | 2/1945 | Breisch et al. . | |
| 2,371,896 | 3/1945 | Knauer . | |
| 2,835,523 | 5/1958 | Chervenka | 292/19 X |
| 3,186,746 | 6/1965 | Attwood et al. | 292/19 |
| 3,232,566 | 2/1966 | Eisenberg . | |
| 3,966,242 | 6/1976 | Vitalis | 292/19 |
| 4,053,130 | 10/1977 | Birkner . | |
| 4,327,264 | 4/1982 | Botz et al. . | |
| 4,500,120 | 2/1985 | Ridgewell et al. | 292/19 |

FOREIGN PATENT DOCUMENTS

| | | | |
|---|---|---|---|
| 1299048 | 6/1962 | France | 292/87 |
| 0014523 | 1/1984 | Japan | 292/19 |
| 216163 | 2/1925 | United Kingdom | 292/19 |

*Primary Examiner*—Gary L. Smith
*Assistant Examiner*—Lloyd A. Gall
*Attorney, Agent, or Firm*—Dorsey & Whitney

[57] ABSTRACT

A simple, low cost latching mechanism is provided that can be assembled without the use of tools and that permits both the top and bottom covers of a radio chassis to be quickly and easily latched to or detached from the chassis. The mechanism includes a latch member having a pair of latch arms biased by an integral coil spring towards a latched position, and an open faced support member for the latch member that allows for easy assembly of the mechanism. Release tabs extend through an exterior chassis wall for selectively shifting the latch arms to a released position to free the covers. A locking cam is also provided to selectively lock the latch arms in the latched position.

4 Claims, 6 Drawing Figures

LATCHING MECHANISM

BACKGROUND OF THE INVENTION

1. Field of the Invention

This invention relates to latching mechanisms and, more particularly, to a latching mechanism to secure the cover of a radio or the like to its supporting chassis.

2. Description of the Prior Art

It is desirable to be able to access the internal device componentry of electronic devices quickly and easily, so that inspection, repair and tuning can be made without undue delay and bother. The conventional response to this requirement has been to design electronic device chassis having covers that can be removed with the push of a button. It is also desirable to be able to prevent unwanted access to device componentry. The response to this second need has been to design covers that can be locked, yet that still can be opened easily.

Unfortunately, conventional cover latches that meet the above two needs comprise many interrelated parts. Cover latches that provide easy access coupled with security have been unduly difficult or, at the least, time-consuming, to manufacture and assemble. A latching mechanism that comprised only a few simple parts, that could be assembled without tools, yet could provide easy access and adequate security, would be a decided advantage.

SUMMARY OF THE INVENTION

The latching mechanism hereof in large part solves the problems outlined above. That is to say, the latching mechanism in accordance with the present invention comprises a minimum of parts, is easily assembled, and can be selectively locked to prevent access.

The latching mechanism hereof broadly includes a pair of latch arms shiftable between latched and released positions, a single bifurcated coiled spring integral with the latch arms for urging the latch arms to their latched positions, and a unique, open faced support arrangement for positioning the mechanism on an electronic equipment chassis or the like. The invention has the ability to latch both a top and bottom cover to a chassis with the same latch mechanism.

DESCRIPTION OF THE PREFERRED EMBODIMENT

Figure 1:
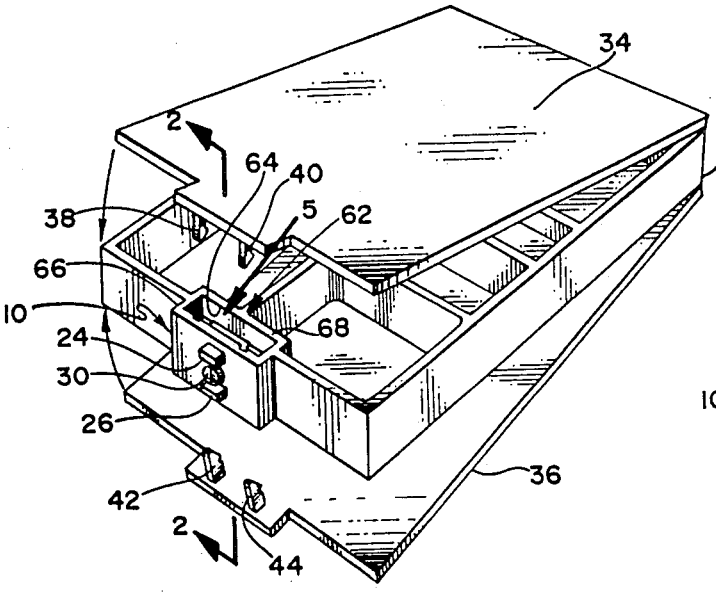
FIG. 1 is a perspective view of a radio chassis having upper and lower hinged covers, and a latch mechanism in accordance with the present invention.

Referring to the drawings, a latching mechanism 10 in accordance with the present invention broadly includes latch member 12, support shaft 14, shaft retaining mounts 16, 18, 20, 22, release tabs 24, 26, and a locking cam 28 having a keyed lock 30. The mechanism 10 is depicted as installed in an electronic equipment chassis 32 having upper and lower covers 34, 36. The upper cover includes notched latch tabs 38, 40, and the lower cover includes notched latch tabs 42, 44.

Latch member 12 includes upper and lower latch arms 46, 48, each supported by respective support rods 50, 52 and 54, 56. The latch member 12 also includes coil springs 58, 60, integrally formed with their respective support rods. The coil springs 58, 60 are aligned along a common longitudinal axis. Support shaft 14 is received within the coil springs 58, 60.

Shaft retaining mounts 16, 18, 20, 22 define an open faced support member for supporting latch member 12 via support shaft 14. The shaft retaining mounts are positioned within latching mechanism retaining sleeve 62 of chassis 32. In particular, shaft retaining mounts 18, 20 are integrally molded with rear wall 64 of sleeve 62, and retaining mounts 16, 22 are integrally molded with the sleeve rear wall 64, and respective sleeve sidewalls 66, 68. Sleeve 62 also includes front wall 70 which provides a second support means for latch member 12 spaced apart and opposed from the open-faced support defined by mounts 16, 18, 20, 22. The front wall 70 includes upper and lower latch tab receiving channels 71, 73, 75, 77.

Figure 2:
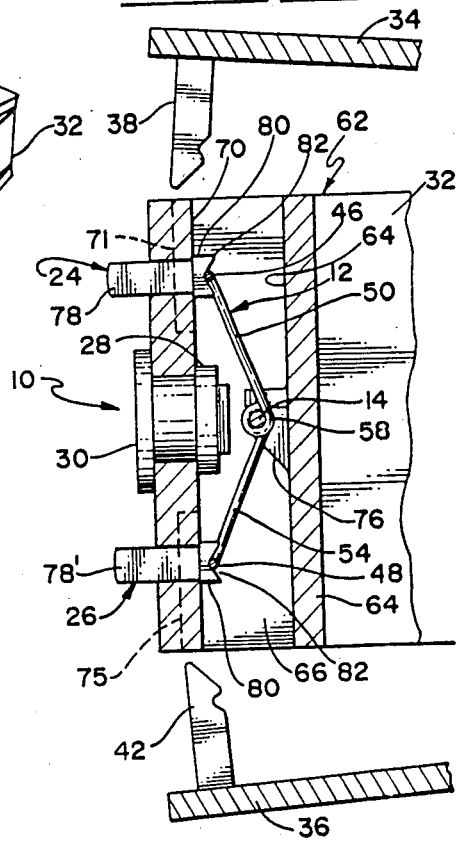
FIG. 2 is a fragmentary sectional view taken along line 2—2 of FIG. 1.
Figure 3:
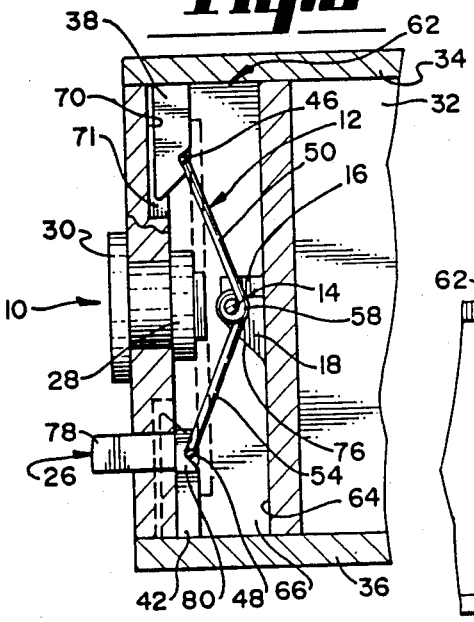
FIG. 3 is similar to FIG. 2 but with the covers shown latched and phantom lines depicting the locking cam in the locked position.
Figure 4:
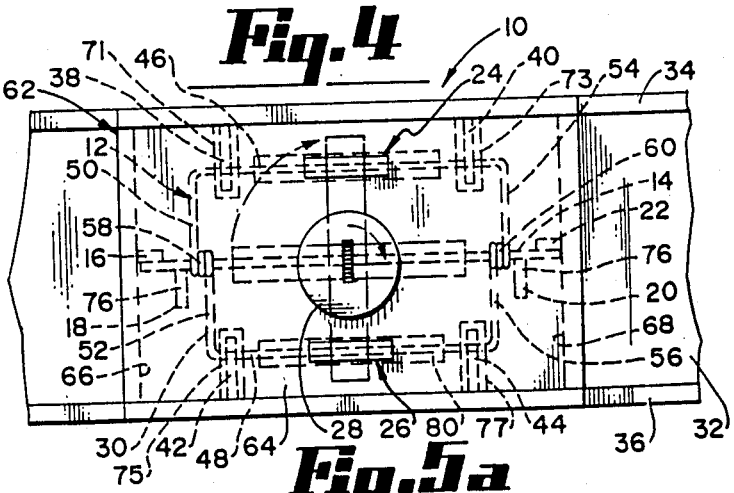
FIG. 4 is a fragmentary front elevational view of the chassis, with the covers latched and phantom lines depicting the internal latch parts.
Figure 5:
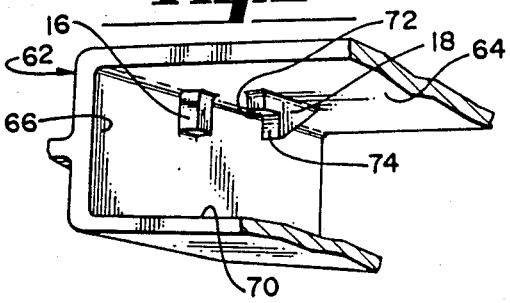
FIG. 5 is a fragmentary perspective view taken at 5 in FIG. 1, with parts removed for clarity.
Figure 5A:
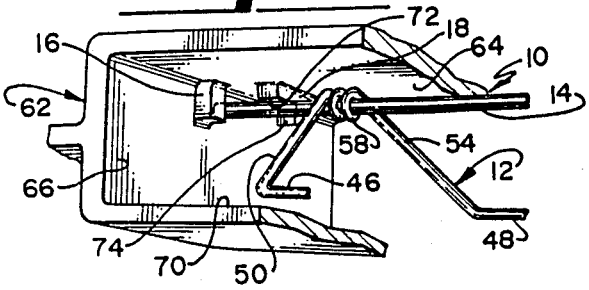
FIG. 5*a* is similar to FIG. 5 but with the latch arms and support shaft depicted.

Referring to FIGS. 5 and 5*a*, shaft retaining mounts 18, 20 each include a shaft supporting top wall 72, shaft supporting sidewall 74, and inclined sidewall 76. Shaft retaining mounts 16, 22 include a support shaft retaining sidewall opposed to the shaft retaining sidewall 74 of mounts 18, 20. Referring to FIG. 5*a*, the support shaft 14 is positioned by the support surfaces of the top wall 72 and sidewall 74 of retaining mounts 18, 20, and the opposed sidewalls of retaining mounts 16, 22. As can be seen in FIGS. 2, 3 and 5*a*, the coil springs 58, 60 urge the latch arms 46, 48 towards the front wall 70 of sleeve 62, thereby locking support shaft 14 in the open face support defined by mounts 16, 18, 20, 22.

Release tabs 24, 26 each include an actuating portion 78 that extends through front wall 70 of sleeve 62, and a latch arm engaging portion 80 generally perpendicular to the portion 78. The latch arm engaging portions 80 include a V-shaped in cross section front wall 82.

The keyed lock 30 extends through the front wall 70, and exposes a tumbler hole for a key on the exterior of the outer chassis. Locking cam 28 rotates when the lock 30 is turned by a key. In the unlocked position, the locking cam 28 is positioned parallel, and in clearing relationship, to the latch arms 46 and 48. In the locked position, locking cam 28 is positioned directly behind each of the latch arms 46, 48, blocking movement of the latch arms 46, 48.

In operation, the cover 34 is lowered so that the notched tabs 38 and 40 enter the recessed portions 71 and 73 in the front wall 70. As the cover 34 is pressed toward the chassis 32, the angular ends of the notched tabs 38, 40 ride on the latch arm 46 and displace the latch arm 46 away from the front wall 70. Displacing the latch arm 46 in this direction causes the spring to expand and increase its resistance to movement. The latch arm 46 snaps into place in the notch in each of the notched tabs 38 and 40 as the cover reaches its final closed position. Latching of the bottom cover 36 is accomplished in a like manner with latch tabs 42, 44 being latched by latch arm 48. In fact, both covers can be closed and latched into place simultaneously.

The unique design of the latch mechanism 10 permits assembly of the mechanism without tools. In particular, release tabs 24 and 26 are first inserted through the front wall 70 of the latch mechanism retaining sleeve 62. Support shaft 14 is then installed within the coil springs 58, 60 of the latch member 12. The latch member 12 is then preferably inserted through the bottom of the sleeve 62 (as depicted in the figures), such that the support rod 14 slides up the inclined sidewalls 76 of shaft retaining mounts 18, 20. The support shaft 14 snaps into place into the open face support defined by retaining mounts 16, 18, 20, 22. The latch arms 46, 48 are then inserted into the V-shaped front wall of respective release tabs 24, 26.

To accomplish release of the cover 34, the release tab 24 is pressed inwardly. As the release tab 24 moves toward the sleeve rearwall 64, the release tab 24 moves the latch arm 46 out of engagement with the notches in the notched tabs 38, 40. The cover 34 can be swung open when the latch arm 46 has cleared the notches of notched tabs 38, 40. The bottom cover 36 is released in a similar manner using release tab 26. Furthermore, the two covers 34, 36 can be released at the same time by simultaneously depressing release tabs 24, 26.

I claim:

1. A latching mechanism for selectively engaging a latch tab, comprising:

a retaining sleeve including a front wall and an opposed rear wall;

a latch member including a first latch arm having opposed ends, said first latch arm oriented generally parallel to said front wall, a first pair of opposed support rods for supporting respective opposed ends of said first latch arm, each of said first pair of support rods operably coupling said first latch arm to a respective one of a pair of coiled springs, said coiled springs axially aligned along a common spring axis, said spring axis being generally parallel to said first latch arm;

a latch member support shaft received through said coiled springs along said axis;

opposed, open faced support mounts operably coupled to said rear wall for receiving said support shaft, said coiled springs urging said first latch arm against said front wall and said shaft into said rear wall open faced mounts; and a first latch arm release tab received through said front wall for selectively shifting said first latch arm away from said front wall, against the urging of said coiled springs.

2. A latching mechanism as claimed in claim 1, including a locking mechanism pivotally supported on said front wall, including a locking cam shiftable between a latch arm locking position wherein said locking cam is interposed between said first latch arm and said rear wall, inhibiting said first latch arm from being shifted away from said front wall, and a first latch arm clearing position wherein said locking cam clears said latch arm.

3. A latching mechanism as claimed in claim 1, said latch member including a second latch arm having opposed ends, said second latch arm oriented generally parallel to said first latch arm, a second pair of opposed support rods for supporting respective opposed ends of said second latch arm, each of said second pair of support rods operably coupling said second latch arm to a respective one of said pair of coiled springs, said coiled springs urging said second latch arm against said front wall, and a second latch arm release tab received through said front wall for selectively shifting said second latch arm away from said front wall.

4. A latching mechanism as claimed in claim 1, said open faced support mounts including a raised shaft supporting surface and an inclined sidewall, whereby said shaft can be inserted within said open faced mounts by shifting said latch arms along said front wall and, at the same time, shifting said shaft along said inclined mount sidewalls.

* * * * *